United States Patent [19]

Piguet

[11] Patent Number: 4,587,387

[45] Date of Patent: May 6, 1986

[54] ELECTRIC SWITCH WITH PREBIASED CONTACT SPRING

[75] Inventor: Paul Piguet, La Chaux-de-Fonds, Switzerland

[73] Assignee: Transicoil, Inc., Worcester, Pa.

[21] Appl. No.: 598,272

[22] PCT Filed: Jul. 8, 1983

[86] PCT No.: PCT/CH83/00089

§ 371 Date: Mar. 7, 1984

§ 102(e) Date: Mar. 7, 1984

[87] PCT Pub. No.: WO84/00442

PCT Pub. Date: Feb. 2, 1984

[30] Foreign Application Priority Data

Jul. 9, 1982 [CH] Switzerland ..... 4194/82

[51] Int. Cl.[4] ..... H01H 5/18

[52] U.S. Cl. ..... 200/67 D

[58] Field of Search ..... 200/67 D, 67 DA, 290

[56] References Cited

U.S. PATENT DOCUMENTS

| | | | |
|---|---|---|---|
| Re. 28,578 | 10/1975 | Burch et al. | 200/67 DA |
| 2,476,045 | 7/1949 | Kaminky | 200/67 D |
| 2,495,349 | 1/1950 | Rohr | 200/67 D |
| 3,133,170 | 5/1964 | Nanninga | 200/159 B |
| 3,213,244 | 10/1965 | McCarrick | 200/67 DA |
| 3,944,768 | 3/1976 | Aryamane et al. | 200/67 D |
| 4,032,734 | 6/1977 | Burch | 200/67 DA |
| 4,424,506 | 1/1984 | Burch | 200/67 D |

*Primary Examiner*—Stephen Marcus
*Assistant Examiner*—R. S. Kidorf
*Attorney, Agent, or Firm*—Woodcock Washburn Kurtz Mackiewicz & Norris

[57] ABSTRACT

The contact spring (7) comprises two outer lamellar branches (71, 72) and two inner lamellar branches (73, 74) subjected to the action of a prebiasing member (6) integral with an actuating member. Two stationary stops (9, 10) are arranged on either side of a transverse connection portion (77) of the spring (7) and have each a plane contact surface extending at least throughout the length of the portion (77) and susceptible of extension throughout one portion of the length of the two outer branches of the spring (7). The actuation force, as well as the stroke of the prebiased spring, may be very important with respect to the size of the switch, the electric contact being suddenly established with an appreciable contact force.

4 Claims, 4 Drawing Figures

ELECTRIC SWITCH WITH PREBIASED CONTACT SPRING

BACKGROUND OF THE INVENTION

The present invention relates to an electric switch with biased contact spring, said spring comprising two lamellar outer branches and two lamellar inner branches arranged between said outer branches, one of the ends of each of the inner branches being connected by means of a curved part to one end of the near outer branch, the two other ends of the outer branches being connected to each other by means of a transverse connecting part, the free ends of the inner branches being connected to a biasing member arranged for spreading apart said ends from their unstressed position, the biasing member being arranged in fixed relationship with an actuating member and the biased spring co-operating with two fixed stops arranged on either side of the transverse connecting part of the spring. Such a spring is known from the U.S. Pat. No. 4,032,734 according to which the biased spring bears, in a first end position, against a first pointed fixed stop. In a second end position, the biased spring comes into contact with a second pointed stop, arranged approximately symmetrically to the first one, with respect to the longitudinal axis of the spring. Between these two end positions, the spring effects a flexing and a twisting movement about an axis parallel to said longitudinal axis, and the actual snapping movement only takes place over a very small distance.

The structure and the mode of operation proposed in the before-mentioned U.S. patent require relatively large minimum dimensions of the switch so that the stroke of the spring, as well as the actuating force, will be relatively larger than that required by certain applications.

This invention has for its object the provision of a switch which can be of very small dimensions, while having relatively great actuating force and stroke of the contact spring, and yet having a response which is extremely reliable. It is a further object of the present invention to provide a switch which is activated by a very sudden motion of the contact spring, establishing an excellent electrical contact.

This is obtained in accordance with the invention by the fact that each of the two fixed stops which precludes travel of the biased contact spring has a planar contact surface extending at least over the length of the transverse connecting part of that biased contact spring.

Preferably, at least one of the two fixed stops extends over at least one part of the length of the two outer branches of the biased spring.

According to an embodiment of the invention, the actuating member is coupled with a substantially planar return spring, comprising outer and inner substantially annular parts, which are co-axial and connected to each other over a portion of their periphery, the outer part being connected, over a portion of its periphery diametrically opposite to the portion by which it is connected to the inner part, to a part of the return spring which is in fixed relationship with said fixed stops.

BRIEF DESCRIPTION OF THE DRAWING

The invention will be better understood by reference to the attached the attached drawing, in which.

DETAILED DESCRIPTION OF THE PREFERRED EMBODIMENT

Figure 2:
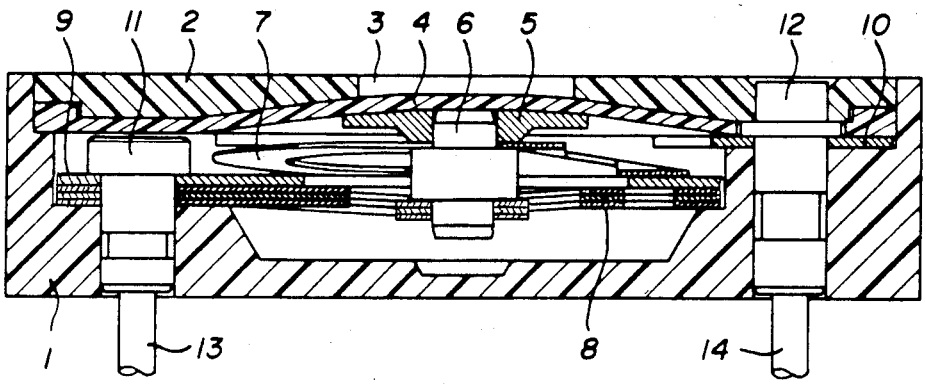
FIGS. 2 and 3 are sectional views along section line II—II of FIG. 1, showing respectively the two end positions of the members of this switch.
Figure 3:
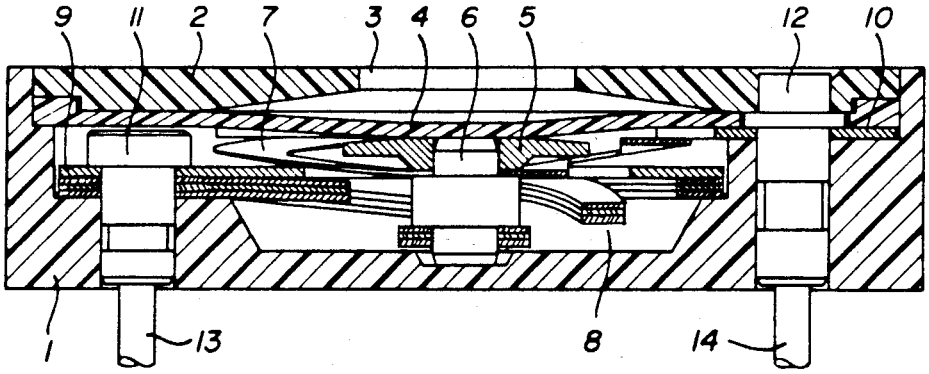

As shown more particularly in FIGS. 2 and 3, the present switch comprises a housing 1 closed by a cover 2, these two parts being made of an electrically insulating material. The cover 2 has a central opening 3. Under this cover is arranged a flexible membrane 4, also electrically insulating, the central part of which is accessible through the opening 3 and bears against an actuating member 5 movable between the two extreme positions represented respectively in FIGS. 2 and 3.

An actuating member 5 is made of metal and is in fixed relationship with a fastening part 6 also made of metal, thus electrically conducting. The actuating member 5 is also in fixed relationship, through this fastening part, with, on the one hand, the central portion of a contact spring 7, and, on the other hand, the central portion of a return spring 8. Two flat contact parts 9 and 10 form fixed stops for the spring 7, and are arranged at a certain distance from one another in the direction of the movement of the actuating member 5, and are fastened to the housing 1 by means of connecting plugs, two of which, 11 and 12, can be seen in the section of FIGS. 2 and 3. The connecting plug 11, in particular, also serves to fasten an outer part of return spring 8 to the housing 1. The contact parts 9 and 10 and the connecting plugs, as well as, of course, spring 8, being made of an electrically conducting material, are provided for the purpose of being electrically connected by means of parts such as 13, 14 of plugs 11 and 12, to an external electrical circuit.

Figure 1:
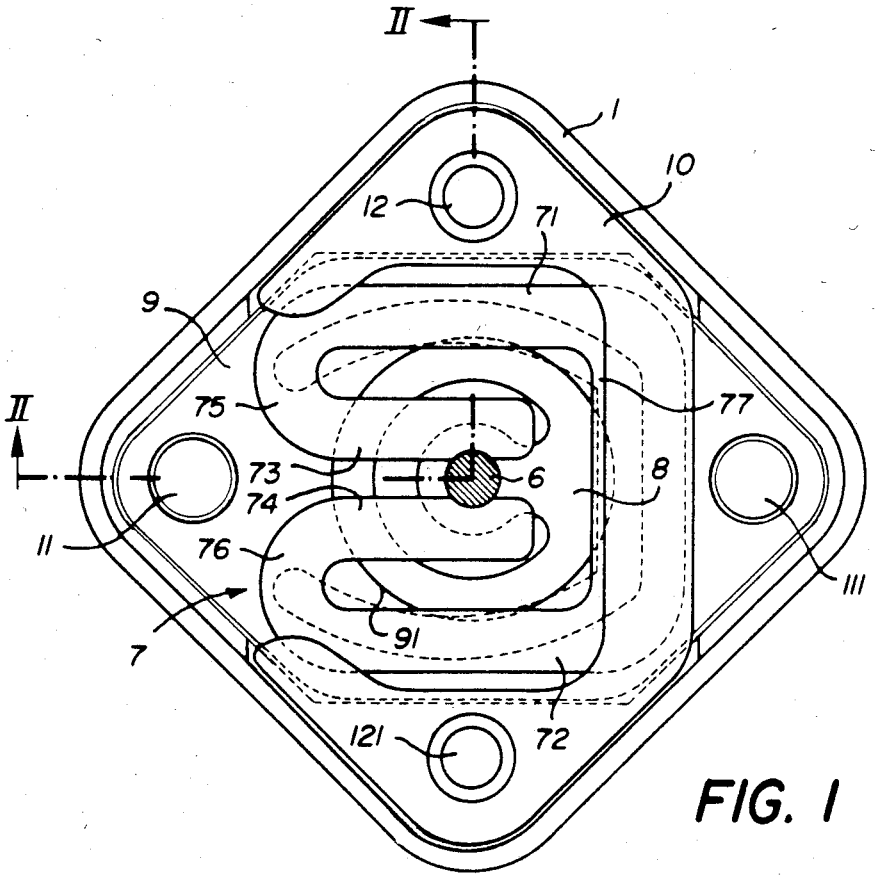
FIG. 1 is a top view of the inner part of a switch according to the invention.

FIG. 1 shows, in a top view, the internal part of the switch, the cover 2 and the membrane 4 being taken off and fastening part 6 being cut at the level of the inner end of spring 7. A plane view is thus provided of the shape of the contact part 10, of the shape of contact spring 7, and of that of contact part 9 which has a central opening 91. The return spring 8, formed by three stacked flat spring elements, as shown in the section of FIGS. 2 and 3, can be seen only partially in FIG. 1, through the opening 91.

FIG. 1 also shows the connecting plug 11 and a similar plug 111, arranged symmetrically to 11 with respect to the axis of part 6, and having the same function as plug 11. Similarly, a plug 121 corresponds to plug 12, these two plugs being also arranged symmetrically with respect to the axis of part 6. It is understood that each of the connecting plugs, or only one plug of each pair 11, 111; 12, 121 can be connected to the external electrical circuit.

The contact spring 7 has two outer branches 71, 72 and two inner branches 73, 74 connected to the adjoining outer branches by respective curved parts 75, 76. The ends of the outer branches which are not connected to the inner branches are connected to each other by means of a transverse connecting part 77, which can be seen partially on FIG. 1, under the part 10.

The fastening part 6 forms a biasing member for spring 7, since its diameter at the place where it crosses branches 73, 74 and where it is fastened to the same is such that the inner branches of the spring are spread apart from their unstressed position which they occupy before the mounting. Spring 7 is thus biased, i.e. it is twisted to take the position represented in FIG. 2. In this extreme position, which, in the present case, is the rest position, the transverse connecting part of the outer branches, 77, bears over its whole length against the lower contact part 9, and, in the shown example of the switch, a portion of the outer branches also rests on that lower contact part 9. The central portion of the contact spring is then in its upper end position, in which the membrane 4 bears against the inner surface of cover 2. The actuating member 5 is, furthermore, under the action of return spring 8 bearing against the fastening part 6 and possibly slightly biased in the rest position of the switch according to FIG. 2.

When a pressure is exerted, for instance through a push button, on membrane 4, as well as on the actuating member 5 and fastening part 6, spring 7 is first caused to twist by bearing against lower contact part 9, until the moment when it snaps by a sudden movement into its other extreme position represented in FIG. 3. When passing from the rest position into this second extreme position, all points of the surface of the spring cross approximately at the same instant in the same plane which is parallel to the lower contact part 9. In the final position according to FIG. 3, the central part of spring 7 is in its lower extreme position, the fastening part 6 having abutted against the bottom of housing 1, while the transverse connecting part 77 of the spring is forced into contact over its whole length with the corresponding surface of the upper contact part 10.

Due to the presence of the return spring 8 which is armed in the position of FIG. 3, the switch returns to its rest position as soon as the pressure exerted on the actuating member is released or becomes inferior to the force resulting from the forces of springs 7 and 8 acting on this member in the position of FIG. 3.

Figure 4:
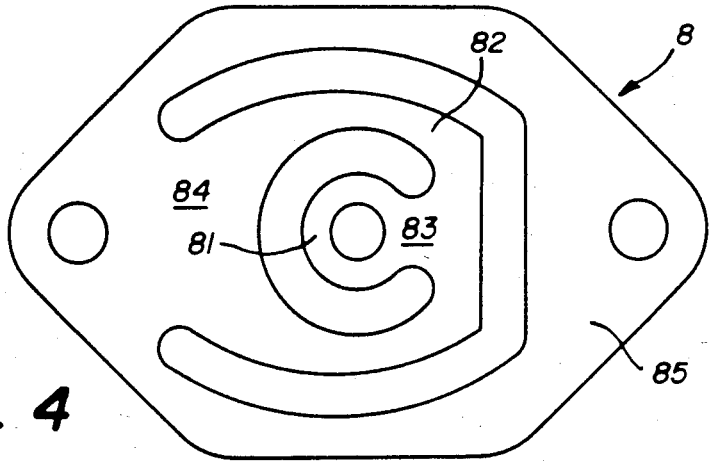
FIG. 4 is a plane view of the return spring.

FIG. 4 shows separately, in plane view, the return spring 8, which includes a substantially annular inner spring part 81, which is mounted on the fastening part 6, an outer spring part 82 connected to the inner part by a portion 83, and a fastening part 85, by which the spring is mounted on housing 1 by means of plugs 11 and 111, so as to be in fixed relationship with contact part 9. Spring part 82 is connected to the fastening part 85 by means of a portion 84 diametrically opposite portion 83. This shape of the return spring appears to be particularly effective to obtain a return force which is well controlled, relatively high and yet which does so in a very limited space. The return spring also permits the actuating force of the switch to have a desired characteristic. Regarding the contact spring, the same can be made under the present conditions in very small dimensions, and can have a very small thickness.

The present switch as a whole allows to obtain a very high actuating force as compared to the dimensions of the switch, a stroke of the biased spring between these two extreme positions which is also comparatively large, and an excellent electrical contact which is established suddenly with a notable contact force.

I claim:

1. An electric switch comprising:

a biased contact spring, said spring having lamellar outer branches and two lamellar inner branches rranged between said outer branches, one of the ends of each of the inner branches being connected by means of a curved part to one end of the near outer branch, the two other ends of the outer branches being connected to each other by means of a transverse connecting part, said connecting part being movable between a first and a second position;

a biasing member, the free ends of the inner branches being connected to that biasing member arranged for spreading apart said free ends from their unstressed position;

an actuating member, the biasing member being arranged in fixed relationship with said actuating member; and two fixed stops, one being situated at said first position and one being situated at said second position, the biased contact spring being movable between said positions and cooperating with said two fixed stops such that each of the two fixed stops has a plane contact surface extending at least over the length of the transverse connecting part of the biased contact spring.

2. A switch according to claim 1, characterized in that at least one of the fixed stops extends over at least a part of the length of the two outer branches of the biased spring.

3. A switch according to claim 1, characterized in that the actuating member is coupled with a substantially planar return spring comprising outer and inner substantially annular parts which are co-axial and connected to each other over a portion of their periphery, the outer part being connected, over a portion of its periphery diametrically opposite to the portion by which it is connected to the innter part, to a part of the return spring which is in fixed relationship with one of said fixed stops.

4. A switch according to claim 2, characterized in that the actuating member is coupled with a substantially planar return spring comprising outer and inner substantially annular parts which are co-axial and connected to each other over a portion of their periphery, the outer part being connected, over a portion of its periphery diametrically opposite to the portion by which it is connected to the inner part; to a part of the return spring which is in fixed relationship with one of said fixed stops.

* * * * *